US006851419B2

(12) United States Patent
Reiner

(10) Patent No.: US 6,851,419 B2
(45) Date of Patent: Feb. 8, 2005

(54) PORTABLE HIKING STOVE

(76) Inventor: Scott Reiner, 1715B Foxworthy Ave., San Jose, CA (US) 95124

( * ) Notice: Subject to any disclaimer, the term of this patent is extended or adjusted under 35 U.S.C. 154(b) by 0 days.

(21) Appl. No.: 10/459,366

(22) Filed: Jun. 10, 2003

(65) Prior Publication Data

US 2004/0250807 A1 Dec. 16, 2004

(51) Int. Cl.[7] ..... A47J 33/000; F24B 1/26; F24C 5/04

(52) U.S. Cl. ..... 126/9 B; 126/9 R; 126/43; 126/44; 126/45; 126/40; 126/50; 126/48

(58) Field of Search ..... 126/9 R, 9 B, 126/9 C, 25 R, 39 R, 43, 44, 45, 46, 47, 48, 49, 40, 50, 38; 431/320; D7/417, 416; D23/332; 248/174, 460; 362/161, 162, 163

(56) References Cited

U.S. PATENT DOCUMENTS

| | | | | | |
|---|---|---|---|---|---|
| 492,896 | A | * | 3/1893 | Sohner | 362/162 |
| 610,194 | A | * | 9/1898 | Neil | 362/162 |
| 713,531 | A | * | 11/1902 | Taylor | 126/43 |
| 736,606 | A | * | 8/1903 | Duket | 24/3.13 |
| 902,036 | A | * | 10/1908 | Williams | 362/162 |
| 1,207,553 | A | * | 12/1916 | Hill | 126/29 |
| 1,298,116 | A | * | 3/1919 | Stonebridge | 362/162 |
| 1,584,940 | A | * | 5/1926 | Hornecker | 248/174 |
| 1,879,837 | A | * | 9/1932 | Bierlich | 126/43 |
| 2,173,166 | A | * | 9/1939 | Hoelscher | 126/25 R |
| 2,488,014 | A | * | 11/1949 | Higman | 126/59 |
| 2,627,263 | A | * | 2/1953 | Anderson | 126/38 |
| 3,025,849 | A | * | 3/1962 | Zimmerman | 126/43 |
| 3,109,420 | A | * | 11/1963 | Ott et al. | 126/9 R |
| 3,384,066 | A | * | 5/1968 | Tufts | 126/9 R |
| 3,683,886 | A | * | 8/1972 | Metzner et al. | 126/9 R |
| 4,211,206 | A | * | 7/1980 | Darbo | 126/9 R |
| 4,331,125 | A | * | 5/1982 | Storandt | 126/25 B |
| 4,351,314 | A | * | 9/1982 | Morton | 126/59 |
| 4,532,910 | A | | 8/1985 | Longley, Jr. | |
| 4,794,906 | A | | 1/1989 | Longley, Jr. | |
| 4,907,140 | A | * | 3/1990 | Overstreet | 362/162 |
| 5,134,990 | A | * | 8/1992 | Bradfield | 126/25 B |
| 5,264,996 | A | * | 11/1993 | Bele et al. | 362/162 |
| 5,269,286 | A | * | 12/1993 | Cowan | 126/25 B |
| 5,329,917 | A | * | 7/1994 | Young | 126/29 |
| 5,404,864 | A | * | 4/1995 | Kent, Jr. | 126/9 B |
| 5,682,872 | A | * | 11/1997 | Whitted | 126/29 |

FOREIGN PATENT DOCUMENTS

WO WO 99/21465 * 5/1999

OTHER PUBLICATIONS

"Liberty Mountain Trangia Westwind," http://www.thru-hiker.com/detail.asp?PRODUCT_ID=TR101, *Thru-Hiker*, p. 1, (No date).

"Trangia Westwind Stove," http://www.greatoutdoorsdepot.com/trangia-westwind-stove.html, p. 1, (No date).

"Trangiz Alcohol Stoves," http://www.greatoutdoorsdepot.com/trangia-stoves.html, p. 1, (No date).

"Directions for Use and Recipes," *Trangia*, pp. 1–35; 2000.

* cited by examiner

*Primary Examiner*—Carl D. Price
(74) *Attorney, Agent, or Firm*—Burns Doane Swecker & Mathis, L.L.P.

(57) ABSTRACT

A portable hiking or camping stove, having a base member with an opening dimensioned to receive a burner therein; and three side members dimensioned so as to be assembled together to support the base member therebetween.

18 Claims, 5 Drawing Sheets

FIG. 1 – PRIOR ART

FIG.2 – PRIOR ART

PORTABLE HIKING STOVE

TECHNICAL FIELD

The present invention is a portable stove, suitable for hiking or camping.

BACKGROUND OF THE INVENTION

Trangia, AB of Trangsviken, Sweden sells a variety of hiking and camping stoves, including a three part easily assembled stove, sold under the Trade name Westwind™. The present Applicant believes the Westwind™ stove is made either by Trangia AB or by Liberty Mountain of Salt Lake City, Utah. The Westwind™ stove consists of three identically shaped flat pieces of metal that are fitted together to form a triangular shaped stand for a standard sized alcohol burner.

As will be discussed below, the Trangia Westwind™ stove suffers from a number of disadvantages, related both to its efficiency and to its safety.

SUMMARY OF THE INVENTION

The present invention provides a portable hiking stove, comprising: a base member having an opening dimensioned to receive a burner therein; and three side members dimensioned so as to be assembled together to support the base member therebetween.

In optional preferred aspects, each of the three side members have a slot at one end and a tongue at another end, such that the tongue of one side member is received into the slot in another side member when the ends of the three side members are assembled together, thus forming a generally triangular shaped support for a base member.

In optional preferred aspects, each side member includes a protrusion at one end, with the protrusions projecting outwardly from the three corners where the side members are assembled together. The protrusions may be used to support an optional wind screen thereon. Preferably, the optional windscreen is a cylindrical shaped.

In optional preferred aspects, each of the three side members includes at least one tab for supporting the base member. Preferably, the tab comprises a C-shaped cut out section with the center of the tab being bent at an angle with respect to a generally planar surface of the side member. More preferably, a pair of C-shaped cut out sections are provided on each side member. In various aspects, such C-shaped cut out sections may be disposed upside down with respect to none another, or disposed perpendicular to one another.

DETAILED DESCRIPTION OF THE DRAWINGS

Figure 1:
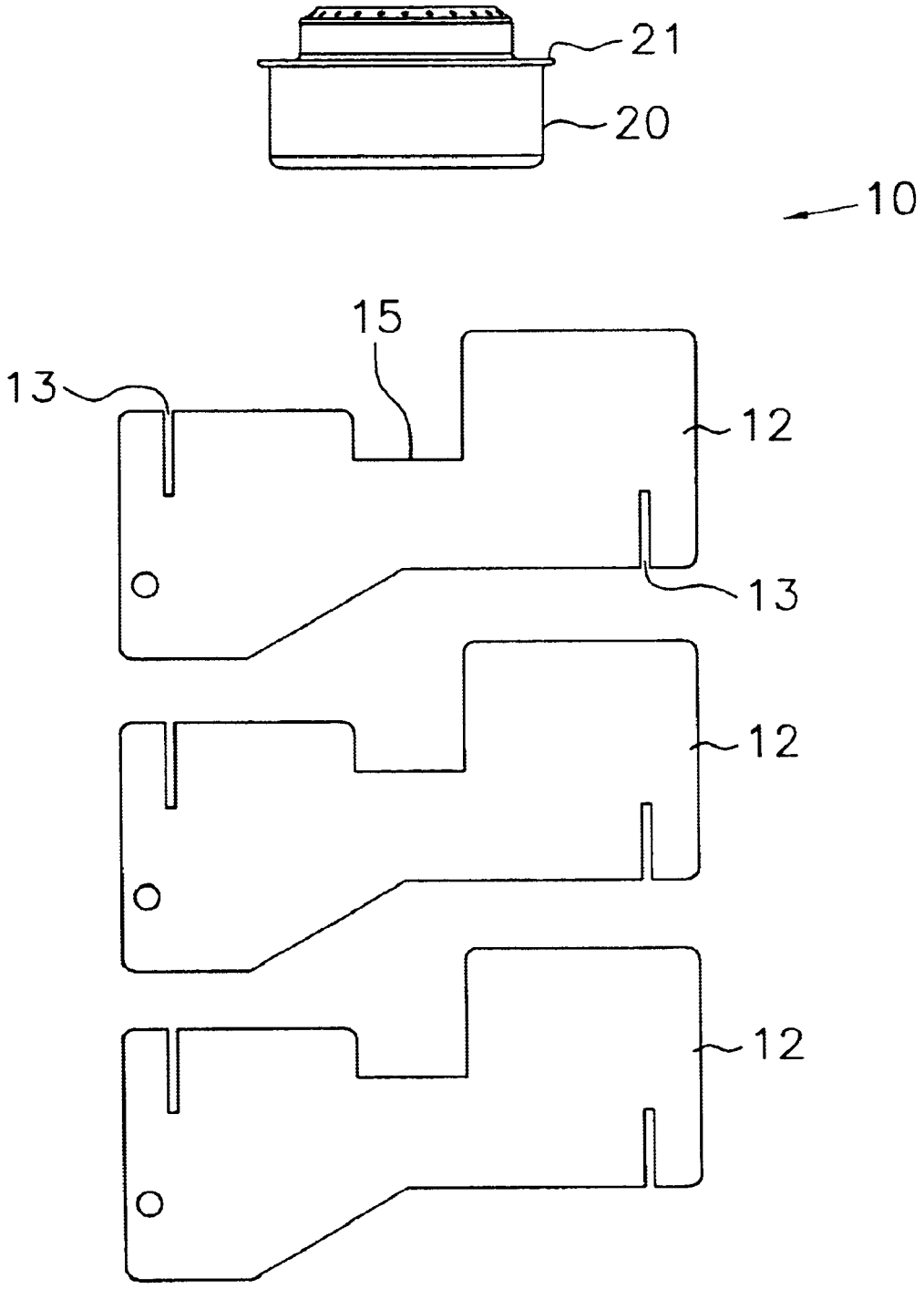
FIG. 1 is a view of the components of a Trangia Westwind™ stove in unassembled form.
Figure 2:
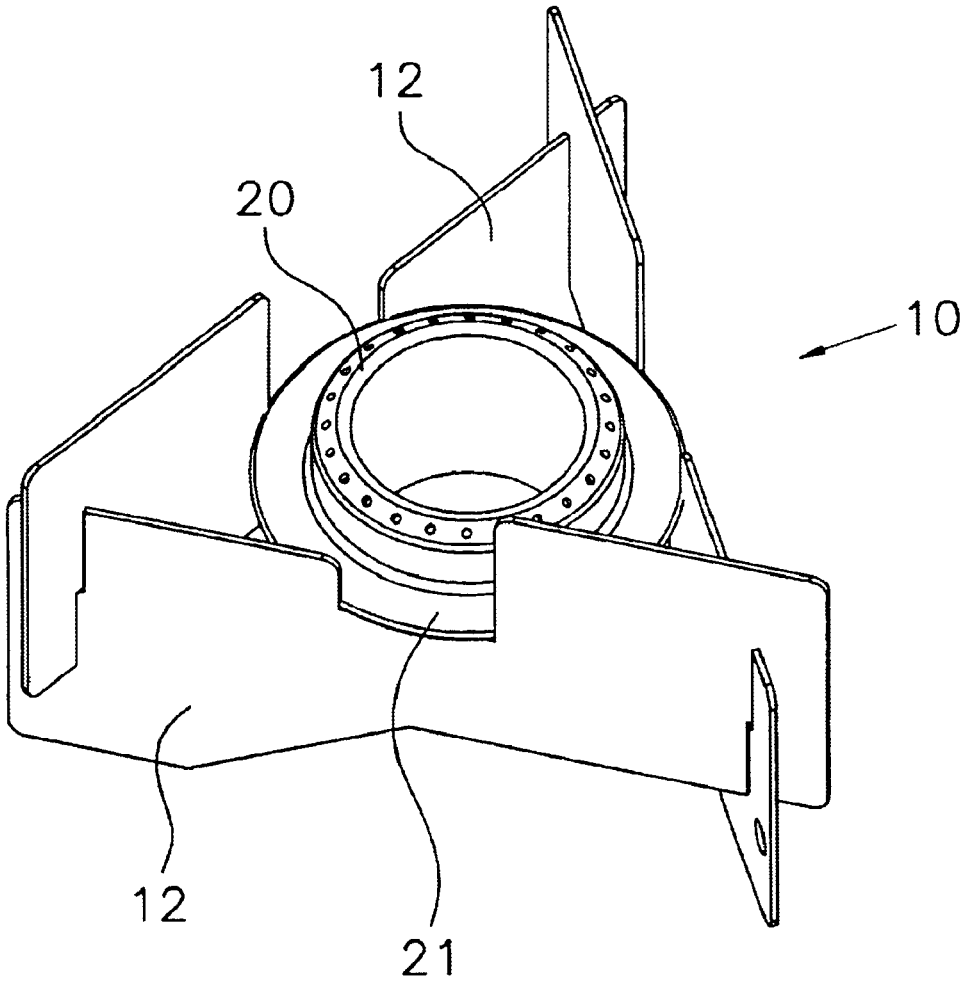
FIG. 2 is a perspective view of an assembled Trangia Westwind™ stove.

FIGS. 1 and 2 illustrate an existing Trangia Westwind™ stove. FIGS. 3 to 7 illustrate the present invention. As will be explained, the advantages of the present invention become apparent by comparing the present invention to the existing Trangia Westwind™ stove.

FIG. 1 shows the components of a Trangia Westwind™ stove. Stove 10 is assembled from three identically shaped planar side members 12, each having slots 13 cut therein. The three side members 12 are then assembled together, with the slot 13 of one member 12 mated with the slot 13 of another member 12 to form the triangular shaped structure as shown in FIG. 2. An alcohol burner 20 is then placed down into the top end of the assembled stove 10, with an outwardly projecting lip 21 of burner 20 resting on supporting surfaces 15 of each of side members 12.

The present invention will now be explained. Referring to FIGS. 3 to 6, a stove 30 is provided. Stove 30 comprises three side members 40 which are dimensioned so as to be assembled together to support a base member 50 therebetween. Base member 50 has an opening 52 dimensioned to receive a standard alcohol burner 20 therein. It is to be understood that the present invention may preferably be dimensioned to use the same standard alcohol burner 20 as was used in the Trangia Westwind™ stove 10 discussed above. However, the present invention is not so limited. Instead, the present invention can be dimensioned to hold any other size of burner (being alcohol, or non-alcohol) therein, as is desired.

Preferably, base member 50 comprises air passages 54 around center opening 52. Air passages 54 may comprises a series of holes positioned equally around center opening 52, as shown. However, the present invention is not so limited since other air passage designs through base member 50 are also contemplated within the scope of the present invention.

Figure 3:
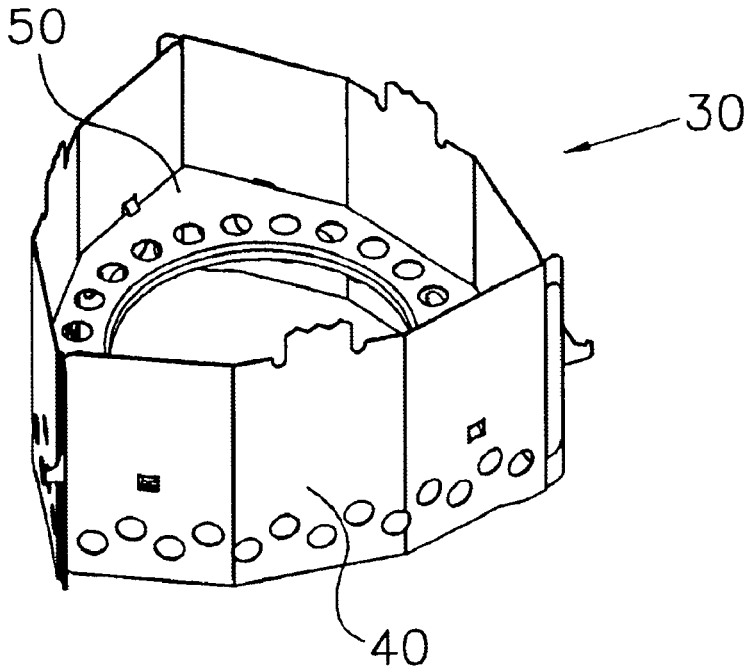
FIG. 3 is a perspective view of the present invention in assembled form.

As seen in FIG. 3, side members 40 are connect to one another at their respective ends, without any additional fasteners, couplers or connectors being required. For example, instead of requiring fasteners, each of the three side members 40 may simply have a slot 42 at one end and a tongue 44 at another end, wherein the tongue 44 of one side member 40 is received into the slot 42 of another side member 40 when the three side members 40 are assembled together to form stove 30.

Advantageously, side members 40 may be identical in shape and inter-replaceable as shown, thereby facilitating an easy set up of stove 30. Side members 40 and base member 50 are preferably made of stainless steel or titanium, but the present invention is not so limited.

Figure 5:
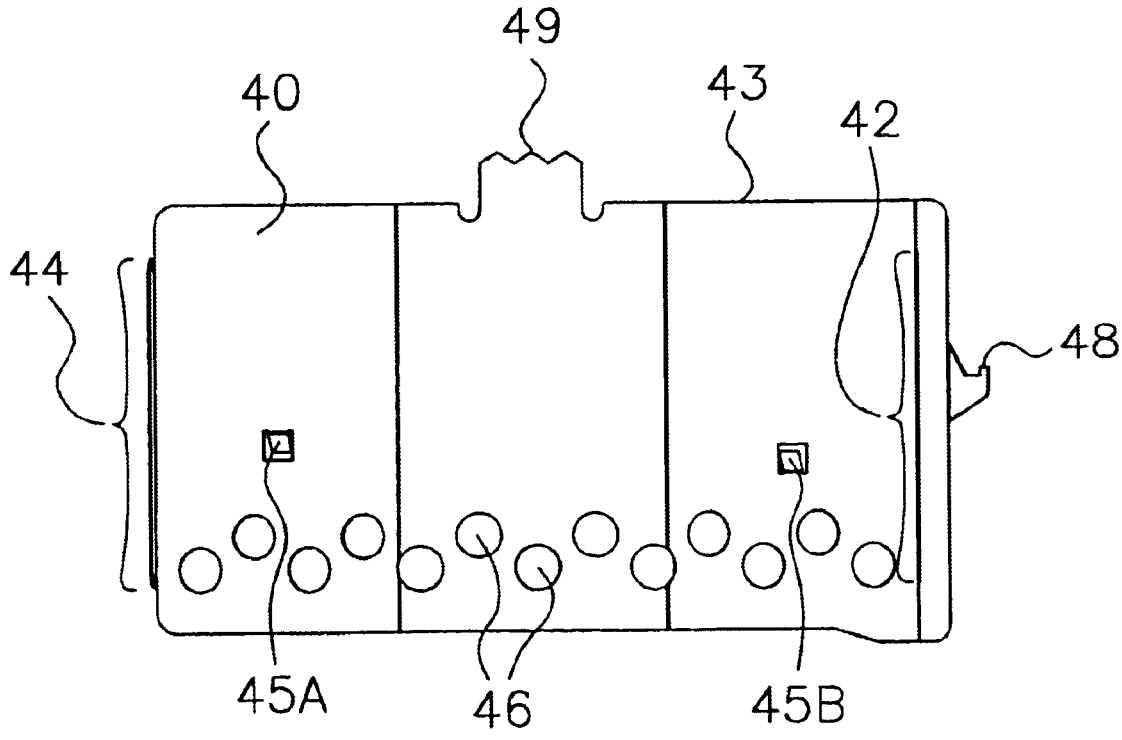
FIG. 5 is a front elevation view of a side member of the present invention.

Side members 40 have air passages 46 passing therethrough. Preferably, air passages 46 are positioned below a level at which base member 50 is supported by side members 40. Base member 50 may preferably be supported by one or more tabs 45 on side members 40. Specifically, each of tabs 45 may preferably comprise a C-shaped cut out section, as illustrated. Most preferably, each side member 40 includes at least a pair of tabs 45A and 45B. As seen in FIG. 5, tab 45A and tab 45B may be disposed upside down with respect to one another. In the illustrated embodiment, the end of tab 45A will rest on the top of base member 50 while the end of tab 45B will support the bottom of base member 50. An advantage of this design is that base member 50 will remain fixed in position between the three side members 40 even if stove 30 is tilted or turned upside down. It is to be understood that alternate structures may also be used to support base 50 between side members 40. Thus, the present invention is not limited simply to C-shaped cut-out tab structures. For example, a dimple may be used instead. However, when tabs 45 are used, it is to be understood that although tabs 45A and 45B may be positioned upside down with respect to one another, tabs 45A and 45B can instead be disposed perpendicular to one another. In such embodiments, the sides (as opposed to the ends) of each of tabs 45 can then be used to support the top and bottom of base member 50.

Figure 6:
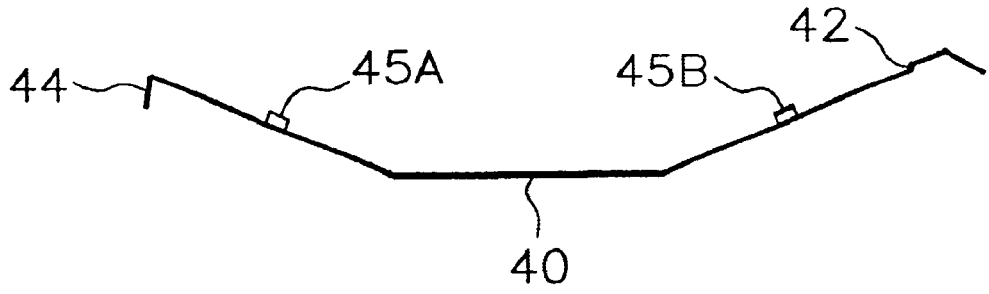
FIG. 6 is a top plan view of a side member of the present invention.

As can be seen in FIG. 6, each side member 40 may be made of planar sections that are angled to one another or otherwise curved such that the three side members form an outwardly bowed triangle (FIG. 4) when assembled together.

Figure 4:
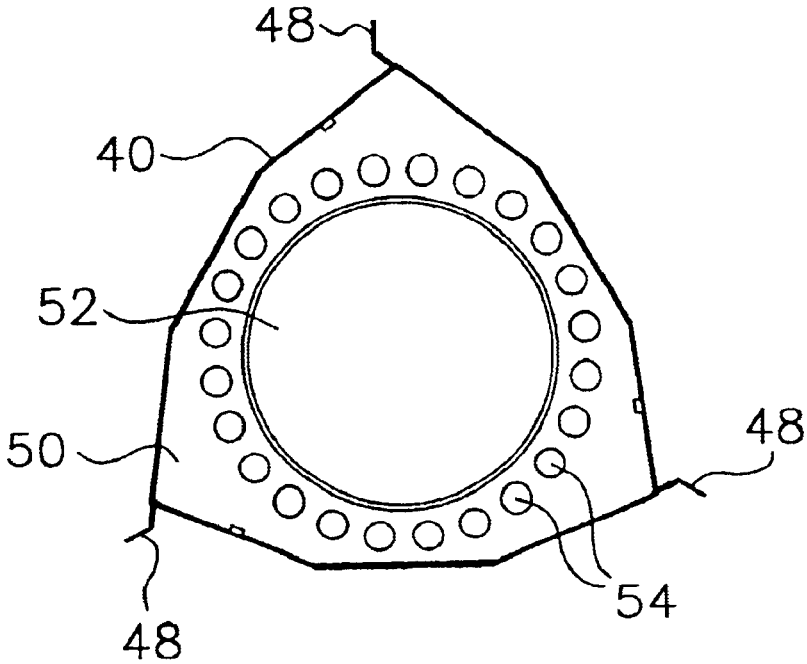
FIG. 4 is a top plan view of the present invention in assembled form.
Figure 7:
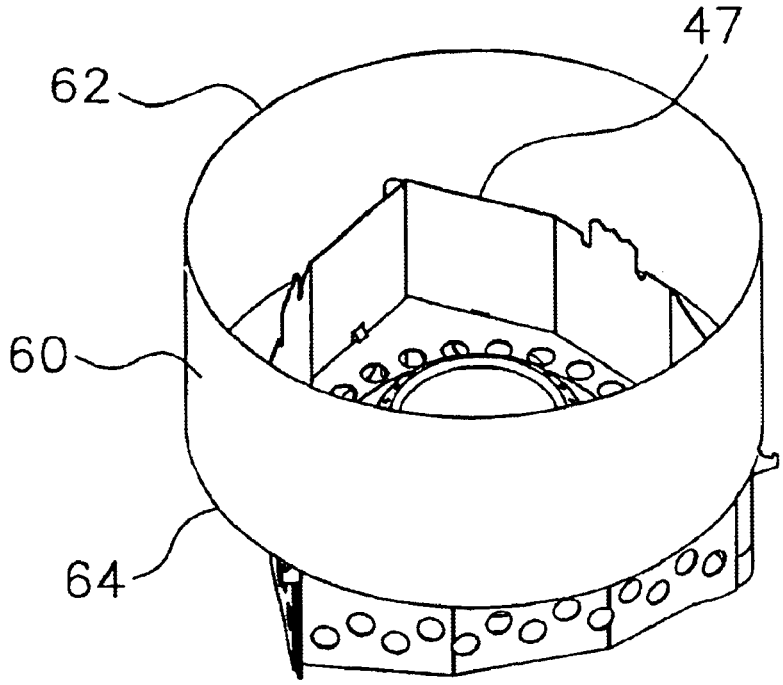
FIG. 7 is a perspective view of the present invention in assembled form with an optional windscreen positioned thereon.
Figure 8:
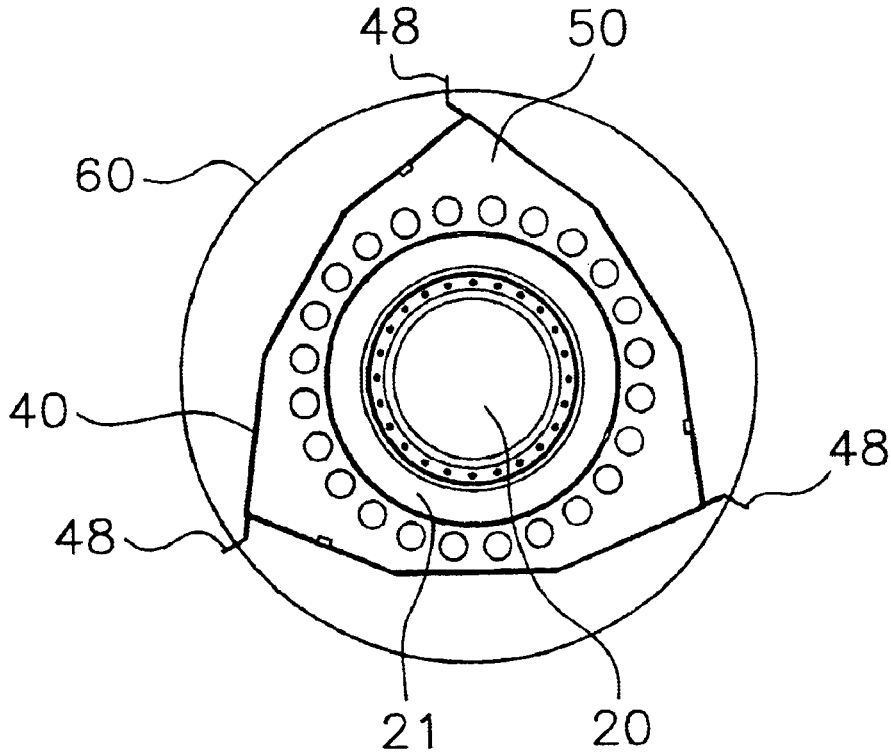
FIG. 8 is a top plan view corresponding to FIG. 7.

In optional preferred aspects, each side member 40 further includes a protrusion 48 at one end, wherein protrusions 48 project outwardly from the three corner locations where side members 40 are assembled together (as shown in FIGS. 4 and 8). Protrusions 48 act as tabs that may then be used to support an optional windscreen 60 thereon. Windscreen 60 is preferably cylindrical in shape. As can be seen in FIG. 7, a top end 62 of windscreen 60 may preferably be positioned higher than a top end 47 of side members 40 when windscreen 60 in positioned on tabs 48. Moreover, tabs 48 may preferably have slots therein into which a bottom end 64 of windscreen 60 is received. In such embodiment, tabs 48 simply act as hooks under the bottom 64 of windscreen 60.

In optional preferred aspects, each side member 40 has an extension 49 projecting upwardly from its top end 47. In this embodiment, extensions 49 are used to support a pot or pan thereon, with the gaps in height between top ends 47 and extensions 49 permitting heated air to flow evenly around the pot or pan and out of stove 30. Optionally, extensions 49 may have a serrated top edge to more firmly grasp onto the bottom of the pot or pan placed thereon.

In alternate embodiments, the windscreen can be dimensioned such that it rests on top end 43 of side members 40. In such embodiment, extensions 49 can project through slots in the windscreen, keeping the windscreen in place on top of the stove.

The present portable stove of FIGS. 3 to 8 has many advantages over the Trangia Westwind™ system shown in FIGS. 1 and 2.

First, the present stove 30 provides an air pocket around burner 20. (IE: the air pocket being the space between burner 20 and side members 40). This air pocket tends to retain the heat of burner 20 and focus the heat on the bottom of the pot or pan resting on extensions 49 above buffer 20. In addition, the metallic interiors of side member 40 may act as reflective surfaces which further assists in focusing heating on the bottom of the pot or pan placed above burner 20. In contrast Trangia's Westwind™ stove 10 does not provide an air pocket around its burner 20. Instead, its burner 20 rests directly on the three side members 12. Thus, burner 20 is fully exposed to wind, which would tend to temper the heating effect of burner 20 at those locations where burner 20 contacts side members 12.

Second, air flows evenly around all sides of burner 20 in the present stove 30. In part, this even air flow is caused by each of side members 40 being angled or curved (see FIG. 6) so that stove 30 is an outwardly bowed triangle shape (see FIG. 4) with holes 46 in side member 40 and holes 54 in base member 50 also permitting even air flow around all sides of burner 20. In contrast, Trangia's Westwind™ stove 10 is simply triangular in shape, with its burner 20 exposed to wind at the edges of stove 10, as explained above.

Third, the present stove 30 is considerably safer than the Trangia's Westwind™ stove since the operator's fingers are not directly exposed to burner 20. Specifically, burner 20 of the present stove 30 is not positioned at an edge of the stove 30, but is instead positioned recessed away from the three side members 40, and thus away from an operator's fingers.

Fourth, an air pocket is created under base member 50 with holes 46 providing an entrance into this air pocket, and holes 54 providing an exit from the top of this pocket. An advantage of such air pocket is that air is pre-heated under burner 20. This feature increases the heating ability of the present stove 30.

Fifth, the present stove 30 supports its burner 20 at a position lower than the Westwind™ burner, thereby giving the present stove 30 greater stability, and shielding the burner 20 from the wind.

Sixth, a further advantage of the present stove 30 is that extensions 49 on the top of the side members 40 provide a much improved balance of stability (for a pot or pan positioned thereon) and airflow, as opposed to the Westwind™ design. Specifically, with the Westwind™ design, a concentrated airflow occurs under the pot or pan at only three (corner) locations, whereas in the present stove 30, air flows evenly under the pot or pan.

Seventh, a further advantage of the present invention is its "hole design". Specifically, holes 46 and 54 act as a baffle by allowing a sufficient amount of air to reach burner 20 while at the same time preventing warmed air from simply being pulled away from the burner 20 by the effects of wind.

Lastly, the present stove 30 is preferably made of stainless steel or titanium, whereas the Trangia Westwind™ is made of aluminum which becomes bendable over time. This limitation is not found with the present system's stainless steel or titanium construction.

Test Data

Test 1 (Still Air):

Location: Indoors, Santa Clara, Calif.

Air Temperature: 71° F.

Fuel Amount Per Test: 3.0 oz. (By Volume, Kleen Strip Brand Denatured Alcohol)

Water Amount Per Test: 16 oz. (Tap Water)

Pot: Standard Trangia 27 Duossal Pot, Covered with titanium pot lid

Burner: Standard Trangia open alcohol burner

Water Temperature Goal: None—visual check for boiling water.

Purpose: The goal of this test was to discover the effect of the distance between the burner and the pot on boil time and fuel consumption. Five different arrangements were tested. These test were performed with no external windscreen. These units have 42, 0.234 inch diameter holes on each side wall (3 side walls per stove unit) and 72, 0.219 inch diameter holes on the burner platform (1 burner platform per stove unit). This gives a total of 5.29 square inches of open space through the bottom perimeter of the stove and 2.71 square inches of open space through the burner platform.

H=Distance between top of burner and bottom of pot $A_{base}$=Area of open space around bottom perimeter of stove $A_{burner}$=Area of open space through the burner platform $A_{total}=A_{base}+A_{burner}$ Area Ratio=$A_{base}/A_{burner}$ Test Arrangements:

5052 Aluminum stove with no holes blocked:

H=1.34 inches (lowest height possible)

$A_{base}$=5.29 square inches evenly spaced $A_{burner}$=2.71 square inches evenly spaced $A_{total}$=8.00 square inches Area Ratio: 1.95

2. 5052 Aluminum stove with no holes blocked:
H=1.27 inches (lowest height possible)
$A_{base}$=5.29 square inches evenly spaced
$A_{burner}$=2.71 square inches evenly spaced
$A_{total}$=8.00 square inches
Area Ratio: 1.95
3. 5052 Aluminum stove with no holes blocked:
H=1.17 inches (lowest height possible)
$A_{base}$=5.29 square inches evenly spaced
$A_{burner}$=2.71 square inches evenly spaced
$A_{total}$=8.00 square inches
Area Ratio: 1.95
4.5052 Aluminum stove with no holes blocked:
H=1.07 inches (lowest height possible)
$A_{base}$=5.29 square inches evenly spaced
$A_{burner}$=2.71 square inches evenly spaced
$A_{total}$=8.00 square inches
Area Ratio: 1.95
5052 Aluminum stove with no holes blocked:
H=0.97 inches (lowest height possible)
$A_{base}$=5.29 square inches evenly spaced
$A_{burner}$=2.71 square inches evenly spaced
$A_{total}$=8.00 square inches
Area Ratio: 1.9
Results

| Arrangement | $A_{base}$ (Square inches) | $A_{burner}$ (Square inches) | $A_{total}$ (Square inches) | Hole Ratio ($A_{base}/A_{burner}$) | Burner Height (inches) | Time (Seconds) | Fuel Consumed (Ounces) |
|---|---|---|---|---|---|---|---|
| 1 | 5.29 | 2.71 | 8.00 | 1.95 | 1.34 | 6:10 | 0.75 |
| 2 | 5.29 | 2.71 | 8.00 | 1.95 | 1.27 | 6:20 | 0.60 |
| 3 | 5.29 | 2.71 | 8.00 | 1.95 | 1.17 | 6:30 | 0.55 |
| 4 | 5.29 | 2.71 | 8.00 | 1.95 | 1.07 | 6:40 | 0.50 |
| 5 | 5.29 | 2.71 | 8.00 | 1.95 | .97 | 7:10 | 0.65 |

Conclusions:

As the distance between the burner and the pot is decreased, boil time increases, but fuel consumption decreases up to a certain point. Once that point is reached boil time increases, but fuel consumption begins to increase as well. With this arrangement of open air space, the distance between the burner and the pot should be established somewhere between 1.34 and 1.07 inches.

Test 2

Location: Inside Garage, San Jose, Calif.
Air Temperature: 60° F. (measured with accurate digital thermometer)
Fuel Amount Per Test: 1.5 oz. (By Volume, Kleen Strip Brand Denatured Alcohol)
Water Amount Per Test: 16 oz. (Tap Water)
Water Temperature: 64° F.
Pot: Standard Trangia 27 Duossal Pot, Uncovered
Burner: Standard Trangia open alcohol burner
Water Temperature Goal: 210° F. (measured with accurate digital thermometer)
Part 1—No Wind (Inside Garage):

Purpose: The goal of this test was to test a stove unit with one particular arrangement of open air space against the standard Westwind™ stove which is a commercially available collapsible stove that also uses the Trangia open alcohol burner. This test was performed with no external windscreen. This unit has 17, 0.313 inch diameter holes on each side wall (3 side walls per stove unit) 24, 0.272 inch diameter holes on the burner platform (1 burner platform per stove unit). This gives a total of 3.92 square inches of open space through the bottom perimeter of the stove and 1.39 square inches of open space through the burner platform. Aluminum tape was used to block holes to create variations in open area.

H=Pot Rest Tab Height
$A_{base}$=Area of open space around bottom perimeter of stove
$A_{burner}$=Area of open space through the burner platform
$A_{total}=A_{base}+A_{burner}$
Area Ratio=$A_{base}/A_{burner}$
Test Arrangements:
304 Stainless Steel stove with all holes open:
$A_{base}$=3.92 square inches evenly spaced
$A_{burner}$=1.39 square inches evenly spaced
$A_{total}$=5.31 square inches
Area Ratio: 2.82

2. Standard Westwind™ stove:

Results:

| Arrangement | $A_{base}$ (Square inches) | $A_{burner}$ (Square inches) | $A_{total}$ (Square inches) | Hole Ratio ($A_{base}/A_{burner}$) | Time (Seconds) | Fuel Consumed (Ounces) |
|---|---|---|---|---|---|---|
| 1 | 3.92 | 1.39 | 5.31 | 2.82 | 7:41 | .88 |
| 2 | — | — | — | — | 16:00 | 1.0 |

Conclusions:

With this particular arrangement of open air space the stove performance was significantly better than that of the Westwind™ stove. The boil time was less than half that of the Westwind™ and fuel consumption was better as well.

Part 2 (Moderate Wind):

Purpose: Same as Part 1, above, except with a light wind instead of still air. The wind was generated by a small box type set on low speed placed 72 inches from the stoves. The wind created by the fan can be classified as a moderate wind.

Test Arrangements:
304 Stainless Steel stove with all holes open:
$A_{base}$=3.92 square inches evenly spaced $A_{burner}$=1.39 square inches evenly spaced
$A_{total}$=5.31 square inches
Area Ratio: 2.82
2. Standard Westwind™ stove:
Results:

| Arrangement | $A_{base}$ (Square inches) | $A_{burner}$ (Square inches) | $A_{total}$ (Square inches) | Hole Ratio ($A_{base}/A_{burner}$) | Time (Seconds) | Fuel Consumed (Ounces) | Maximum Temperature Reached (Degrees F.) |
|---|---|---|---|---|---|---|---|
| 1 | 3.92 | 1.39 | 5.31 | 2.82 | 10:45 | Ran Out | 160 |
| 2 | — | — | — | — | 7:00 | Ran Out | 95 |

Conclusions:

In moderate wind conditions the stove with this particular arrangement of open air pace performed significantly better than that of the Westwind™ stove. While neither stove was able to bring the water to a boil, arrangement 1 burned for much longer and raised the water temperature much more than arrangement 2 before running out of fuel.

Test 3:

Location: Indoors, Santa Clara, Calif.
Air Temperature: 74° F. (measured with accurate digital thermometer)
Fuel Amount Per Test: 2.1 oz. (By Weight, Kleen Strip Brand Denatured Alcohol measured on digital postage scale)
Water Amount Per Test: 16 oz. (Tap Water)
Pot: Standard Trangia 27 Duossal Pot, Uncovered
Burner: Standard Trangia open alcohol burner
Water Temperature Goal: 190° F. (measured with accurate digital thermometer)
Weight of Aluminum Stove: 2.5 oz.
Weight of Stainless Steel Stove: 3.4 oz.

Part 1 (Still Air—No Wind):

Purpose: The goal of this test was to find an arrangement of air holes on the stove in still air (no wind) conditions that would give a satisfactory balance of fast boil time vs. low fuel consumption. A secondary goal was to compare aluminum vs. stainless steel as a material for stove construction. A final goal was to see if asymmetrical arrangements of perimeter holes (similar to that of the original Trangia 27) would produce good results in wind conditions. Six different arrangements were tested simultaneously. These test were performed with no external windscreen. These units have 42, 0.234 inch diameter holes on each side wall (3 side walls per stove unit) and 72, 0.29 inch diameter holes on the burner platform (1 burner platform per stove unit). This gives a total of 5.29 square inches of open space through the bottom perimeter of the stove and 2.71 square inches of open space through the burner platform. Aluminum tape was used to block holes to create variations in open area.

$A_{base}$=Area of open space around bottom perimeter of stove
$A_{burner}$=Area of open space through the burner platform
$A_{total}=A_{base}+A_{burner}$
Area Ratio=$A_{base}/A_{burner}$ Test Arrangements:

5052 Aluminum stove with no holes blocked:

$A_{base}$=5.29 square inches evenly spaced
$A_{burner}$=2.71 square inches evenly spaced
$A_{total}$=8.00 square inches
Area Ratio: 1.95

2. 5052 Aluminum stove with one side wall completely covered:

$A_{base}$=3.53 square inches asymmetrically spaced
$A_{burner}$=2.71 square inches evenly spaced
$A_{total}$=6.24 square inches
Area Ratio: 1.30

3. 5052 Aluminum stove with two side walls completely covered:

$A_{base}$=1.76 square inches asymmetrically spaced
$A_{burner}$=2.71 square inches evenly spaced.
$A_{total}$=4.47 square inches
Area Ratio: 0.65

5052 Aluminum stove with bottom row of holes left open all around:

$A_{base}$=1.42 square inches evenly spaced
$A_{burner}$=2.71 square inches evenly spaced
$A_{total}$=4.13 square inches
Area Ratio: 0.5

5.5052 Aluminum stove with no holes blocked on side wall and 24 holes blocked symmetrically on burner platform (2 rows left open all around burner):

$A_{base}$=5.29 square inches evenly spaced
$A_{burner}$=1.81 square inches evenly spaced
$A_{total}$=7.10 square inches
Area Ratio: 2.92

304 Stainless Steel stove with no holes blocked:

$A_{base}$=5.29 square inches evenly spaced
$A_{burner}$=2.71 square inches evenly spaced
$A_{total}$=8.00 square inches
Area Ratio: 1.95

7. 5052 Aluminum stove with bottom row of holes left open all around and inner row of holes left open on burner platform:

$A_{base}$=1.42 square inches evenly spaced
$A_{burner}$=0.90 square inches evenly spaced
$A_{total}$=2.32 square inches
Area Ratio: 1.58

8. 5052 Stainless Steel stove with bottom row of holes left open all around and inner row of holes left open on burner platform:

$A_{base}$=1.42 square inches evenly spaced
$A_{burner}$=0.90 square inches evenly spaced
$A_{total}$=2.32 square inches
Area Ratio: 1.58

Results:

| Arrangement | $A_{base}$ (Square inches) | $A_{burner}$ (Square inches) | $A_{total}$ (Square inches) | Hole Ratio ($A_{base}/A_{burner}$) | No Wind Time (Seconds) | No Wind Fuel Consumed (Ounces) |
|---|---|---|---|---|---|---|
| 1 | 5.29 | 2.71 | 8.00 | 1.95 | 6:15 | 0.7 |
| 2 | 3.53 | 2.71 | 6.24 | 1.30 | 6:20 | 0.7 |
| 3 | 1.76 | 2.71 | 4.47 | 0.65 | 6:25 | 0.5 |
| 4 | 1.42 | 2.71 | 4.13 | 0.52 | 6:30 | 0.5 |
| 5 | 5.29 | 1.81 | 7.10 | 2.92 | ? | 0.7 |
| 6 | 5.29 | 2.71 | 8.00 | 1.95 | 6:45 | 0.5 |
| 7 | 1.42 | 0.90 | 2.32 | 1.58 | 6:30 | 0.5 |
| 8 | 1.42 | 0.90 | 2.32 | 1.58 | 6:30 | 0.5 |

Conclusions:

In general, the larger the total area ($A_{total}$) was, the faster the boil time and the higher the fuel consumption was. There did not appear to be a direct correlation between Area Ratio and boil time/fuel consumption. When no holes were blocked the Aluminum stove and the stainless steel stove performed differently with the stainless steel version being slower, but more fuel efficient. However, when they were restricted to a total area of 2.32 (Area Ratio of 1.6) they performed exactly the same.

Part 2 (Strong Wind):

Purpose: Same as Part 1, above, except this test was performed in a steady wind condition. Also, determine whether asymmetrical hole spacing is a benefit in windy conditions. The wind was generated by a circular fan set on medium speed placed 36 inches from the stoves. The wind created by the fan can be classified as a strong wind.

Test arrangements: Same as above. On stove units with asymmetrical hole spacing, units were arranged with solid walls facing into the wind.

Results:

| Arrangement | $A_{base}$ (Square inches) | $A_{burner}$ (Square inches) | $A_{total}$ (Square inches) | Hole Ratio ($A_{base}/A_{burner}$) | No Wind Time (Seconds) | No Wind Fuel Consumed (Ounces) | Wind Time (Seconds) | Wind Fuel Consumed (Ounces) | Maximum Temperature Reached (Degrees F.) |
|---|---|---|---|---|---|---|---|---|---|
| 1 | 5.29 | 2.71 | 8.00 | 1.95 | 6:15 | 0.7 | 9:00 | Ran Out | 180 |
| 2 | 3.53 | 2.71 | 6.24 | 1.30 | 6:20 | 0.7 | 8:45 | Ran Out | 185 |
| 3 | 1.76 | 2.71 | 4.47 | 0.65 | 6:25 | 0.5 | 9:00 | 2.1 | — |
| 4 | 1.42 | 2.71 | 4.13 | 0.52 | 6:30 | 0.5 | 9:35 | 1.8 | — |
| 5 | 5.29 | 1.81 | 7.10 | 2.92 | ? | 0.7 | 8:05 | Ran Out | 172 |
| 6 | 5.29 | 2.71 | 8.00 | 1.95 | 6:45 | 0.5 | 7:15 | Ran Out | 162 |
| 7 | 1.42 | 0.90 | 2.32 | 1.58 | 6:30 | 0.5 | 8:15 | 1.2 | — |
| 8 | 1.42 | 0.90 | 2.32 | 1.58 | 6:30 | 0.5 | 8:30 | 1.2 | — |

Conclusions:

Asymmetrical hole spacing was not shown to have a significant benefit under windy conditions. In addition to that, asymmetrical hole spacing requires one of the stove side walls to be different from the others so it is a disadvantage in manufacturing and will therefore be abandoned from this point on. In windy conditions there did not appear to be a correlation between total area ($A_{total}$) and boil time. However, fuel consumption decreased as total area decreased. There was no direct correlation between Area Ratio and boil time/fuel consumption. Once again when comparing aluminum vs. stainless steel, there is a significant difference when no holes are blocked, but when total area is restricted to 2.32 (Area Ratio of 1.6) the difference is very slight. In this case the stainless steel stove displayed only a slightly longer boil time with fuel consumption being the same as the aluminum stove. Aluminum stoves softened (lost temper) significantly after repeated heating and cooling. Also, several failed catastrophically during earlier wind testing due to thermal stress. Since the stainless steel stoves are not susceptible to thermal stress at the burner temperatures and perform similarly in boil time/fuel consumption tests this material is preferable despite a slight weight increase.

Test 4
Location: Indoors, Santa Clara, Calif.
Air Temperature: 72° F. (measured with accurate digital thermometer)
Fuel Amount Per Test: 2.1 oz. (By Weight, Kleen Strip Brand Denatured Alcohol measured on digital postage scale)
Water Amount Per Test: 16 oz. (Tap Water)
Pot: Standard Trangia 27 Duossal Pot, Uncovered
Burner: Standard Trangia open alcohol burner Water Temperature Goal: 210° F. (measured with accurate digital thermometer)

Part 1 (Still Air—No Wind):

Purpose: The goal of this test was to discover the relationship of the height of the pot-rest tabs and boil time/fuel consumption in still air (no wind) conditions. The pot-rest tabs are the 3 small tabs that protrude from the top edge of the stove unit (i.e. extensions 49). Two different arrangements were tested. These test were performed with stove units with no external windscreen. These units have 42, 0.234 inch diameter holes on each side wall (3 side walls per stove unit) and 72, 0.219 inch diameter holes on the burner platform (1 burner platform per stove unit). This gives a total of 5.29 square inches of open space through the bottom perimeter of the stove and 2.71 square inches of open space through the burner platform. Aluminum tape was used to block holes to create variations in open area.

H=Pot Rest Tab Height
$A_{base}$=Area of open space around bottom perimeter of stove
$A_{burner}$=Area of open space through the burner platform
$A_{total}=A_{base}+A_{burner}$
Area Ratio=$A_{base}/A_{burner}$
Test Arrangements:
304 Stainless Steel stove with bottom row of holes left open all around and inner row of holes left open on burner platform:
H=0.312 inches
$A_{base}$=1.42 square inches evenly spaced
$A_{burner}$=0.90 square inches evenly spaced
$A_{total}$=2.32 square inches
Area Ratio: 1.58
2. 304 Stainless Steel stove with bottom row of holes left open all around and inner row of holes left open on burner platform:
H=0.125 inches
$A_{base}$=1.42 square inches evenly spaced
$A_{burner}$=0.90 square inches evenly spaced
$A_{total}$=2.32 square inches
Area Ratio: 1.58
Results:

| Arrangement | $A_{base}$ (Square inches) | $A_{burner}$ (Square inches) | $A_{total}$ (Square inches) | Hole Ratio ($A_{base}/A_{burner}$) | Pot-rest Tab Height (inches) | Time (Seconds) | Fuel Consumed (Ounces) |
|---|---|---|---|---|---|---|---|
| 1 | 1.42 | 0.90 | 2.32 | 1.58 | 0.312 | 7:40 | 0.7 |
| 2 | 1.42 | 0.90 | 2.32 | 1.58 | 0.125 | 9:00 | 0.5 |

Conclusions:

Decreasing the height of the pot-rest tabs from 0.312 inches to 0.125 inches increased boil time and decreased fuel consumption.

Part 2 (Strong Wind):

Purpose: Same as Part 1, above, except this test was performed in a steady wind condition. The wind was generated by a circular fan set on low speed placed 24 inches from the stoves. The wind created by the fan can be classified as a strong wind.

Test Arrangements: Same as above.

Results:

| Arrangement | $A_{base}$ (Square inches) | $A_{burner}$ (Square inches) | $A_{total}$ (Square inches) | Hole Ratio ($A_{base}/A_{burner}$) | Pot-rest Tab Height (inches) | Time (Seconds) | Fuel Consumed (Ounces) | Max Temperature Reached (Degrees F.) |
|---|---|---|---|---|---|---|---|---|
| 1 | 1.42 | 0.90 | 2.32 | 1.58 | 0.312 | 11:20 | Ran Out | 153 |
| 2 | 1.42 | 0.90 | 2.32 | 1.58 | 0.125 | 11:00 | 1.9 | — |

Conclusions:

In strong wind conditions decreasing the height of the pot-rest tabs from 0.312 inches to 0.125 inches resulted in a significant improvement in performance with respect to boil time and fuel consumption.

Part 3 (Moderate Wind):

Purpose: Same as Part 2, above, except wind intensity was decreased. The wind was generated by a circular fan set on medium speed placed 36 inches from the stoves. The wind created by the fan can be classified as a moderate wind.

Test Arrangements: Same as above.

Results:

| Arrangement | $A_{base}$ (Square inches) | $A_{burner}$ (Square inches) | $A_{total}$ (Square inches) | Hole Ratio ($A_{base}/A_{burner}$) | Pot-rest Tab Height (inches) | Time (Seconds) | Fuel Consumed (Ounces) |
|---|---|---|---|---|---|---|---|
| 1 | 1.42 | 0.90 | 2.32 | 1.58 | 0.312 | 14:45 | 1.9 |
| 2 | 1.42 | 0.90 | 2.32 | 1.58 | 0.125 | 12:10 | 1.4 |

Conclusions:

In moderate wind conditions decreasing the height of the pot-rest tabs from 0.312 inches to 0.125 inches resulted in a significant improvement in performance with respect to boil time and fuel consumption.

Part 4 (Moderate Wind):

Purpose: Same as Part 3, above, except pot-rest heights were changed from 0.312 and 0.125 to 0.125 and 0.063. Also, compare the performance of these units with that of the standard Trangia 27. The wind was generated by a circular fan set on medium speed placed 36 inches from the stoves. The wind created by the fan can be classified as a moderate wind.

Test Arrangements:

304 Stainless Steel stove with bottom row of holes left open all around and inner row of holes left open on burner platform:

H=. 125 inches $A_{base}$=1.42 square inches evenly spaced $A_{burner}$=0.90 square inches evenly spaced $A_{total}$=2.32 square inches Area Ratio: 1.58

2. 304 Stainless Steel stove with bottom row of holes left open all around and inner row of holes left open on burner platform:

H=0.063 inches $A_{base}$=1.42 square inches evenly spaced $A_{burner}$=3.90 square inches evenly spaced $A_{total}$=2.32 square inches Area Ratio: 1.58

3. Standard Trangia 27 with upper and low er windscreen:

$A_{base}$=4.20 square inches asymmetrically spaced $A_{burner}$=4.83 square inches evenly spaced $A_{total}$=9.03 square inches Area Ratio: 0.87

Results:

| Arrangement | $A_{base}$ (Square inches) | $A_{burner}$ (Square inches) | $A_{total}$ (Square inches) | Hole Ratio ($A_{base}/A_{burner}$) | Pot-rest Tab Height (inches) | Time (Seconds) | Fuel Consumed (Ounces) | Max Temperature Reached (Degrees F.) |
|---|---|---|---|---|---|---|---|---|
| 1 | 1.42 | 0.90 | 2.32 | 1.58 | .125 | 13:35 | 1.6 | — |
| 2 | 1.42 | 0.90 | 2.32 | 1.58 | .063 | 18:00 | Ran Out | 205 |
| 3 | 4.20 | 4.83 | 9.03 | 0.87 | — | 8:48 | 0.5 | — |

Conclusions:

In moderate wind conditions decreasing the height of the pot-rest tabs from 0.125 inches to 0.063 inches resulted in a very significant decrease in performance with respect to boil time and fuel consumption. In this test the standard Trangia 27 showed much better performance than the two stove units tested.

Part 5 (Moderate Wind):

Purpose: Same as Part 4, above, except the unit with a pot-rest height of 0.063 inches had an additional row of air holes opened up around the bottom. The wind was generated by a circular fan set on medium speed placed 36 inches from the stoves. The wind created by the fan can be classified as a moderate wind.

Test Arrangements:

304 Stainless Steel stove with bottom row of holes left open all around and inner row of holes left open on burner platform:

H=0.125 inches $A_{base}$=2.71 square inches evenly spaced $A_{burner}$=0.90 square inches evenly spaced $A_{total}$=3.61 square inches Area Ratio: 3.01

Results:

Pot: Standard Trangia 27 Duossal Pot, Uncovered

| Arrangement | $A_{base}$ (Square inches) | $A_{burner}$ (Square inches) | $A_{total}$ (Square inches) | Hole Ratio ($A_{base}/A_{burner}$) | Pot-rest Tab Height (inches) | Time (Seconds) | Fuel Consumed (Ounces) | Max Temperature Reached (Degrees F.) |
|---|---|---|---|---|---|---|---|---|
| 1 | 2.71 | 0.90 | 3.61 | 3.01 | .063 | 17:00 | Ran Out | 206 |

Conclusions:

In moderate wind conditions providing more open air space around the base of the unit with a pot-rest height of 0.063 increased the performance slightly.

Part 6 (No Wind):

Purpose: Test two stove units each with a different pot-rest height against the standard Trangia 27 in no wind conditions.

Test Arrangements:

304 Stainless Steel stove with bottom row of holes left open all around and inner row of holes left open on burner platform:

H=0.125 inches $A_{base}$=1.42 square inches evenly spaced $A_{burner}$=0.90 square inches evenly spaced $A_{total}$=2.32 square inches Area Ratio: 1.58

2. 304 Stainless Steel stove with bottom row of holes left open all around and inner row of holes left open on burner platform:

H=0.312 inches $A_{base}$=1.42 square inches evenly spaced $A_{burner}$=0.90 square inches evenly spaced $A_{total}$=2.32 square inches Area Ratio: 1.58

3. Standard Trangia 27 with upper and lower windscreen:

$A_{base}$=4.20 square inches asymmetrically spaced $A_{burner}$=4.83 square inches evenly spaced $A_{total}$=9.03 square inches Area Ratio: 0.87

Results:

| Arrangement | $A_{base}$ (Square inches) | $A_{burner}$ (Square inches) | $A_{total}$ (Square inches) | Hole Ratio ($A_{base}/A_{burner}$) | Pot-rest Tab Height (inches) | Time (Seconds) | Fuel Consumed (Ounces) |
|---|---|---|---|---|---|---|---|
| 1 | 1.42 | 0.90 | 2.32 | 1.58 | .125 | 9:10 | 0.7 |
| 2 | 1.42 | 0.90 | 2.32 | 1.58 | .312 | 6:38 | 0.5 |
| 3 | 4.20 | 4.83 | 9.03 | 0.87 | — | 8:32 | 0.3 |

Conclusions:

In no wind conditions increasing the height of the pot-rest tabs from 0.125 inches to 0.312 inches resulted in a very significant increase in performance with respect to boil time and fuel consumption. The standard Trangia 27 showed better performance than stove arrangement 1 with respect to both boil time and fuel consumption. However, when compared to arrangement 2 the Trangia 27 showed better performance only with respect to fuel consumption.

Test 5

Location: Outdoors, San Jose, Calif.

Air Temperature: 85° F. (measured with accurate digital thermometer)

Fuel Amount Per Test: 2.0 oz. (By Volume, Kleen Strip Brand Denatured Alcohol)

Water Amount Per Test: 16 oz. (Tap Water)

Burner: Standard Trangia open alcohol burner

Water Temperature Goal: 210° F. (measured with accurate digital thermometer)

Part 1 (Outdoors—Intermittent Breeze):

Purpose: The goal of this test was to discover the relationship of the height of the pot-rest tabs and boil time/fuel consumption in outdoor (intermittent breeze) conditions. The pot-rest tabs are the 3 small tabs that protude from the top edge of the stove unit. Three different arrangements were tested. These test were performed with stove units with no external windscreen. These units have 42, 0.234 inch diameter holes on each side wall (3 side walls per stove unit) and 72, 0.219 inch diameter holes on the burner platform (1 burner platform per stove unit). This gives a total of 5.29 square inches of open space through the bottom perimeter of the stove and 2.71 square inches of open space through the burner platform. Aluminum tape was used to block holes to create variations in open area.

H=Pot Rest Tab Height $A_{base}$=Area of open space around bottom perimeter of stove $A_{burner}$=Area of open space through the burner platform $A_{total}=A_{base}+A_{burner}$ Area Ratio=$A_{base}/A_{burner}$ Test Arrangements:

304 Stainless Steel stove with bottom row of holes left open all around and fully open holes on burner platform:

H=0.063 inches $A_{base}$=1.42 square inches evenly spaced $A_{burner}$=2.71 square inches evenly spaced $A_{total}$=4.13 square inches Area Ratio: 0.52

2. 304 Stainless Steel stove with bottom row of holes left open all around and fully open holes on burner platform:

H=0.125 inches $A_{base}$=1.42 square inches evenly spaced $A_{burner}$=2.71 square inches evenly spaced $A_{total}$=4.13 square inches Area Ratio: 0.52

3. 304 Stainless Steel stove with bottom row of holes left open all around and fully open holes on burner platform:

H=0.312 inches $A_{base}$=1.42 square inches evenly spaced $A_{burner}$=2.71 square inches evenly spaced $A_{total}$=4.13 square inches Area Ratio: 0.52

Results:

| Arrangement | $A_{base}$ (Square inches) | $A_{burner}$ (Square inches) | $A_{total}$ (Square inches) | Hole Ratio ($A_{base}/A_{burner}$) | Pot-rest Tab Height (inches) | Time (Seconds) | Fuel Consumed (Ounces) |
|---|---|---|---|---|---|---|---|
| 1 | 1.42 | 2.71 | 4.13 | 0.52 | .063 | 13:20 | 1.75 |
| 2 | 1.42 | 2.71 | 4.13 | 0.52 | .125 | 10:42 | 1.35 |
| 3 | 1.42 | 2.71 | 4.13 | 0.52 | .312 | 9:42 | 1.5 |

Conclusions:

Boil time decreased as pot-rest tab height increased. However, the middle pot-rest tab height showed the lowest fuel consumption. The unit with the lowest pot-rest tab height showed very poor performance. Pot-rest tab height should be established somewhere between 0.125 and 0.312 inches.

Part 2 (Outdoors—Intermittent Breeze):

Purpose: Same as Test 1 except a different arrangement of open air space was tested.

H=Pot Rest Tab Height $A_{base}$=Area of open space around bottom perimeter of stove $A_{burner}$=Area of open space through the burner platform $A_{total}=A_{base}+A_{burner}$ Area Ratio=$A_{base}/A_{burner}$ Test Arrangements:

304 Stainless Steel stove with all bottom perimeter holes left open and one row of open holes on burner platform:

H=0.063 inches $A_{base}$=5.29 square inches evenly spaced $A_{burner}$=0.90 square inches evenly spaced $A_{total}$=6.19 square inches Area Ratio: 5.88

2. 304 Stainless Steel stove with all bottom perimeter holes left open and one row of open holes on burner platform:

H=0.125 inches $A_{base}$=5.29 square inches evenly spaced $A_{burner}$=0.90 square inches evenly spaced $A_{total}$=6.19 square inches Area Ratio: 5.88

3. 304 Stainless Steel stove with all bottom perimeter holes left open and one row of open holes on burner platform:

H=0.312 inches $A_{base}$=5.29 square inches evenly spaced $A_{burner}$=0.90 square inches evenly spaced $A_{total}$=6.19 square inches Area Ratio: 5.88

Results:

| Arrangement | $A_{base}$ (Square inches) | $A_{burner}$ (Square inches) | $A_{total}$ (Square inches) | Hole Ratio ($A_{base}/A_{burner}$) | Pot-rest Tab Height (inches) | Time (Seconds) | Fuel Consumed (Ounces) |
|---|---|---|---|---|---|---|---|
| 1 | 5.29 | 0.90 | 6.19 | 5.88 | .063 | 13:09 | 1.5 |
| 2 | 5.29 | 0.90 | 6.19 | 5.88 | .125 | 10:23 | 1.0 |
| 3 | 5.29 | 0.90 | 6.19 | 5.88 | .312 | 9:23 | 1.0 |

Conclusions:

By changing the arrangement of open air space from mostly through the burner platform to mostly through the sidewalls, fuel consumption was improved significantly. Boil time was also improved though not by a large amount.

Test 6

Location: Outdoors, San Jose, Calif.

Air Temperature: 82° F. (measured with accurate digital thermometer)

Fuel Amount Per Test: 2.0 oz. (By Volume, Kleen Strip Brand Denatured Alcohol)

Water Amount Per Test: 16 oz. (Tap Water)

Pot: Standard Trangia 27 Duossal Pot, Uncovered

Burner: Standard Trangia open alcohol burner

Water Temperature Goal: 210° F. (measured with accurate digital thermometer)

Part 1 (Outdoors—Intermittent Breeze):

Purpose: The goal of this test was to test a stove unit with one particular arrangement of open air space against the standard Trangia 27. This test was performed with a stove unit with no external windscreen. This unit has 42, 0.234 inch diameter holes on each side wall (3 side walls per stove unit) and 72, 0.219 inch diameter holes on the burner platform (1 burner platform per stove unit). This gives a total of 5.29 square inches of open space through the bottom perimeter of the stove and 2.71 square inches of open space through the burner platform. Aluminum tape was used to block holes to create variations in open area.

H=Pot Rest Tab Height $A_{base}$=Area of open space around bottom perimeter of stove $A_{burner}$=Area of open space through the burner platform $A_{total}=A_{base}+A_{burner}$ Area Ratio=$A_{base}/A_{burner}$ Test Arrangements:

304 Stainless Steel stove with bottom 3 rows of holes left open all around and inner 2 rows of holes left open on burner platform:

H=0.312 inches $A_{base}$=4.26 square inches evenly spaced $A_{burner}$=1.36 square inches evenly spaced $A_{total}$=5.62 square inches Area Ratio: 3.13

2. Standard Trangia 27 with upper and lower windscreen:

$A_{base}$=4.20 square inches asymmetrically spaced $A_{burner}$=4.83 square inches evenly spaced $A_{total}$=9.03 square inches Area Ratio: 0.87

Results:

| Arrangement | $A_{base}$ (Square inches) | $A_{burner}$ (Square inches) | $A_{total}$ (Square inches) | Hole Ratio ($A_{base}/A_{burner}$) | Pot-rest Tab Height (inches) | Time (Seconds) | Fuel Consumed (Ounces) |
|---|---|---|---|---|---|---|---|
| 1 | 4.26 | 1.36 | 5.62 | 3.13 | .312 | 8:15 | 1.0 |
| 2 | 4.20 | 4.83 | 9.03 | 0.87 | — | 8:15 | .75 |

Conclusions:

With this particular arrangement of open air space the stove performance was very similar to that of the standard Trangia 27. Boil time was equal, but the Trangia 27 consumed less fuel showing it is slightly more efficient. An upper windscreen attached to the stove would probably increase it's efficiency close to that of the Trangia 27.

What is claimed is:

1. A portable stove, comprising:

a base member having an opening dimensioned to receive a burner therein; and three side members dimensioned so as to be assembled together to support the base member therebetween; and, a wind screen dimensioned to be supported by protrusions projecting outwardly from ends of each side member.

2. The stove of claim 1, wherein the base member comprises air passages around the opening.

3. The stove of claim 1, wherein the three side members connect to one another at their ends.

4. The stove of claim 3, wherein the three side members connect to one another without any additional connectors.

5. The stove of claim 1, wherein the three side members each have air passages below a level at which the base member is supported therebetween.

6. The stove of claim 1, wherein the windscreen is cylindrical.

7. The stove of claim 1, wherein an end of the windscreen is higher than an end of the side members when the windscreen is positioned on the protrusions.

8. The stove of claim 1, wherein the three side members are identical in shape.

9. The stove of claim 1, wherein the three side members are dimensioned to be assembled together in a generally triangular shape.

10. The stove of claim 1, wherein each side member has an extension projecting from an end thereof.

11. The stove of claim 1, wherein each of the three side members includes at least one tab positioned to support the base member.

12. The stove of claim 11, wherein the at least one tab comprises a cut out section.

13. The stove of claim 12, wherein the at least one tab comprises a pair of C-shaped cut out sections.

14. The stove of claim 13, wherein the C-shaped cut out sections are disposed upside down with respect to one another.

15. The stove of claim 13, wherein the C-shaped cut out sections are disposed perpendicular to one another.

16. The stove of claim 1, wherein each of the three side members has a slot at one end and a tongue at another end, and wherein the tongue of each side member is received into the slot of another side member when the three side members are assembled together.

17. The stove of claim 1, wherein the three side members form an outwardly bowed triangle when assembled together.

18. The stove of claim 1, wherein each side member has an extension projecting from an end thereof, and wherein the top end of each extension is serrated.

* * * * *